United States Patent [19]

Stauter et al.

[11] 4,087,340

[45] May 2, 1978

[54] PRODUCTION OF METALLIC LEAD

[75] Inventors: John C. Stauter, Streamwood; William K. Tolley, Arlington Heights, both of Ill.

[73] Assignee: UOP Inc., Des Plaines, Ill.

[21] Appl. No.: 769,622

[22] Filed: Feb. 16, 1977

[51] Int. Cl.[2] ..... C25C 1/18

[52] U.S. Cl. ..... 204/117; 204/114

[58] Field of Search ..... 204/114, 117, 105 R

[56] References Cited

U.S. PATENT DOCUMENTS

| | | | |
|---|---|---|---|
| 1,980,809 | 11/1934 | Levy | 204/117 |
| 3,477,928 | 11/1969 | Coltrinari et al. | 204/117 |
| 4,011,146 | 3/1977 | Coltrinari et al. | 204/114 |

*Primary Examiner*—T. M. Tufariello

*Attorney, Agent, or Firm*—James R. Hoatson, Jr.; Raymond H. Nelson; William H. Page, II

[57] ABSTRACT

The production of metallic lead from lead bearing sources such as lead sulfide concentrates may be improved by subjecting the lead sulfide concentrates to a prehalogenation activation treatment at a temperature in the range of from about 300° to about 600° C. before subjecting said concentrate to the halogenation step which is effected at a temperature in the range of from about 80° to about 120° C. followed by leaching, filtering, crystallization and electrolysis.

10 Claims, No Drawings

PRODUCTION OF METALLIC LEAD

BACKGROUND OF THE INVENTION

In standard methods of obtaining metallic lead from concentrates, the standard procedure has been to treat the lead sulfide concentrates in a blast furnace. However, the pyrometallurgical procedure possesses many disadvantages and drawbacks. Primary among these disadvantages is that the process will result in some major pollution problems such as the generation of sulfur oxide gas along with substantial fuming. The fuming carries with it possible carcinogenic compounds which will contain lead, cadmium, etc. Therefore, it is necessary to provide improved and safer methods for obtaining metals such as lead in metallic or elemental form by methods which will not contribute to pollution of the air or will be safer to operate. The aforementioned lead smelting techniques will consist of roast sintering the lead sulfide concentrate whereby a major portion of the sulfur will be removed followed by melting in a blast furnace to obtain the metallic lead.

In an effort to alleviate the pollution problem it is necessary to develop new processes for obtaining lead which will be competitive as an alternative to the conventional smelting practices. Prior work in the hydrometallurgical field resulted in developing a non-aqueous processing route whereby lead sulfide concentrates are chlorinated at temperatures above 300° C. to produce lead chloride and volatilized sulfur. However, chlorination at these elevated temperatures will promote the formation of volatile chlorides of contaminating elements such as iron, magnesium, aluminum, silicon, zinc as well as elemental sulfur which may be present in the lead sulfide concentrate. Other hydrometallurgical processes which have been developed include the use of ferric sulfate as a leach agent. In this method, the lead sulfide is sulfated to form lead sulfate. This step is then followed by carbonation of the lead sulfate to form lead carbonate and thereafter the lead carbonate is subjected to dissolution in hydrofluosilicic acid for electrolysis to metallic lead. Yet another hydrometallurgical method which is developed for the recovery of lead is based on the use of an acidic ferric chloride medium. This method involves a leaching step whereby the lead sulfide is converted to lead chloride and thereafter subjected to steps of solubilizing, crystallization and electrolysis.

The prior art which discloses other processes for converting a lead sulfide to elemental or metallic lead is also exemplified by U.S. Pat. No. 1,491,653. This reference describes the use of chlorides of sulfur and in particular sulfur monochloride to selectively chlorinate lead sulfide in a complex lead-zinc sulfide ore at temperatures ranging from 50° to about 150° C. However, this method is also an aqueous type of operation in that the solids are reacted in a solution of sulfur monochloride to form a slurry. A disadvantage which is present when utilizing such a system is that certain metal sulfides are solubilized due to the dissolution of sulfur into the slurry, this dissolution being due to the wide range of compositions of sulfur chlorides. Such an action can lead to the dissolution of some metal sulfides thereby rendering the process more complex in nature. In addition to this type of operation, another metal recovery system utilizes a dry chlorination of complex sulfides in a two-stage process. The first stage consists in a countercurrent chlorination of the ore in a tube mill with chlorine gas, the temperatures of this process usually being in a range of from about 100° to about 150° C. to insure chlorination of from about 60% to about 70% of the metals. The important step in this stage is the chlorination of iron which serves as a source of chlorine in the second step. The second step of this two-stage process consists in a chloridizing roast wherein the final chlorination is accomplished to convert all metals present in the ore to chlorides. Much of this reaction is done by the release of chlorine by the oxidation of the initially formed ferric chloride to ferric oxide and chlorine. Following this, the metal chlorides are then leached in water and brines in order to solubilize the metals. However, the chloridizing roast to produce ferric chloride will also produce sulfur and sulfur chlorides as well as oxides, the roast temperatures which are necessary to accomplish this being above 138° C. and probably about 150° C.

In addition to the prior art hereinbefore discussed, another reference, namely, U.S. Pat. No. 3,961,941, discloses an activation step in which an ore containing metallic lead and silver is subjected to a roasting step so that the silver bearing mineral may be more easily treated in a subsequent oxidative leach employing an aqueous solution of ferric chloride as the leaching agent, followed by a second leaching with an aqueous solution of sodium chloride to dissolve the salts.

As will hereinafter be shown in greater detail, it has now been discovered that the yields of metallic lead which are obtained from lead bearing sources may be increased when utilizing a prehalogenation activation treatment prior to further steps which include halogenating a lead sulfide source at a relatively low temperature in a dry atmosphere to selectively halogenate the lead.

This invention relates to a hydrometallurgical process for the recovery of metallic lead. More specifically the invention is concerned with an improvement in the process for obtaining metallic lead from lead sulfide concentrate whereby unwanted side reactions such as the halogenation of other metals present in the concentrate are minimized. An attendant advantage of effecting the process in a manner hereinafter set forth in greater detail is that the lead halide which is produced during the reaction is recovered in a purer form than has heretofore been obtainable with the resultant recovery of metallic lead being such that said lead is in a relatively purer state.

It is therefore an object of this invention to provide a process for the production of metallic lead.

A further object of this invention is to provide a hydrometallurgical process for the production of metallic lead from lead sulfide concentrates whereby the lead is recovered in a relatively purer state.

In one aspect an embodiment of this invention resides in a process for the production of metallic lead from a lead bearing source which comprises the steps of: (a) halogenating said lead bearing source; (b) leaching the halogenated source with brine; (c) filtering the resultant solution to separate elemental sulfur, residue and soluble lead halide; (d) crystallizing said lead halide; and (e) recovering metallic lead by electrolysis, the improvement which comprises subjecting said lead bearing source to an activation heat treatment prior to the halogenation step.

A specific embodiment of this invention resides in a process for the production of metallic lead from a lead bearing source in which said lead bearing source is activated by heating said source at a temperature in the range of from about 300° to about 600° C. in an inert or reducing atmosphere, halogenating the activated lead bearing source by treatment with chlorine gas at a temperature in the range of from about 80° to about 120° C., leaching the treated mixture at a temperature of from about 80° to about 120° C. with a sodium chloride solution, filtering the resultant solution at a temperature in the range of from about 80° to about 120° C. to separate elemental sulfur, residue and soluble lead halide, crystallizing said halide, and recovering metallic lead by an electrolysis process utilizing a sodium chloride-lead chloride mixture as the molten salt in which said electrolysis is effected.

Other objects and embodiments will be found in the following further detailed description of the present invention.

As hereinbefore set forth the present invention is concerned with an improvement in a process for the production of metallic lead from lead bearing sources. The improvement in the process comprises subjecting the lead bearing source to an activation heat treatment prior to the halogenation step in which the lead bearing source is selectively halogenated to form a major portion of the source into lead halide. The use of such an activation step prior to the halogenation will provide a higher halogen, and particularly, a higher chlorine utilization for the conversion of lead sulfide to a lead halide such as lead chloride along with a more selective halogenation. The feed stock which is utilized to obtain the metallic lead will comprise either flotation concentrates or raw feed ores which are naturally rich in lead sulfide, although it is also contemplated that a portion of the lead may be present in the form of lead carbonate, sulfate or oxide. In contradistinction to the prior art methods hereinbefore discussed in greater detail such as those methods in which the lead source is subjected to liquid chlorination using sulfur monochloride as the leach or conversion agent to form chlorides of lead, zinc, iron, etc., or a two-step chlorination process in which the first step is effected in such a manner so that little selectivity of the desired lead is obtained, thus necessitating a second conversion step which is effected at a relatively high temperature, the process of the present invention utilizes a dry halogenation step which is effected at relatively low temperatures ranging from about 80° to about 120° C.

The activation of the lead source prior to the halogenation step is effected by heating the lead source such as a lead sulfide concentrate at a temperature in the range of from about 300° to about 600° C. or more prior to the halogenation step in an appropriate apparatus such as an oven. The aforesaid roast is preferably effected in an inert atmosphere or a reducing atmosphere. Examples of inert atmospheres which may be employed include nitrogen atmospheres, helium atmospheres, argon atmospheres, etc., while the reducing atmosphere may be provided by the introduction of hydrogen into the roasting zone. Generally speaking, the lead source is activated by the heat treatment at the aforesaid temperatures for a period of time ranging from about 5 minutes up to about 60 minutes or more. The velocity of the gas which provides the inert or reducing atmosphere may be relatively low and need only be fast enough to purge the volatile materials from the ore as they are formed and sufficient enough to maintain the desired inert or reducing atmosphere and thus preventing any oxidative conditions which may form which will adversely affect the subsequent halogenation of the lead source.

Following the aforesaid activation of the concentrate, the lead source is then subjected to a halogenation step in which the concentrate is subjected to the action of a halogenating agent such as chlorine gas, fluorine gas, bromine, etc., at a temperature of from about 80° to about 120° C. for a period of time which is sufficient to insure conversion of the lead sulfide to the desired lead halide, said halogenating step preferably being effected in a dry atmosphere; the term "dry atmosphere" being defined as an atmosphere wherein the water content of both the atmosphere and the charge stock is not greater than about 0.5%. The treatment of the lead sulfide with the halogenating agent is accomplished in such a manner such as by stirring, mixing, shaking, or by any other means known in the art whereby all of the lead sulfide is contacted with the halogenating agent. The resulting mixture of elemental sulfur which has been formed by the chlorination step along with the lead halide such as lead chloride, lead bromide, or lead fluoride is then subjected to a leaching step. This is effected by treating the resulting mixture with a brine solution at an elevated temperature usually in the range of from about 80° to about 120° C., said brine solution usually comprising an aqueous sodium chloride solution containing from about 20 to about 35% by weight of sodium chloride. The leaching of the mixture usually will take place for a period of time which may range from about 0.5 up to about 2 hours or more in duration, the residence time being that which is sufficient to dissolve the aforesaid lead halide.

Upon completion of the leaching step the solution is filtered while maintaining the temperature of the solution at an elevated range of from about 80° to about 120° C. in order to maintain the lead halide in a soluble form. It is also contemplated within the scope of this invention that the separation of the soluble lead halide and the elemental sulfur which is in solid form may also be effected by flotation and settling whereby, after allowing the solid residue to settle, the liquid is removed by conventional means such as decantation, etc. The solid sulfur and residue which contains gangue, unreacted sulfides of the impurity metals such as zine sulfide, copper sulfide, silver sulfide, and iron sulfide, may be subjected to a recovery treatment. For example, the elemental sulfur may be recovered by a froth flotation method in which the sulfur is preferentially floated. Likewise, a scrubbing step to more fully liberate sulfur from the rest of the residue may also be effected in the presence of a flotation promoter such as organic compounds readily available including kerosene, etc. The treated material is then transferred to a flotation cell, a frothing agent is added, aeration is initiated, and the sulfur-laden froth is removed from the cell. As an alternative method for the recovery of sulfur, the residue may also be treated with aqueous ammonium sulfide in which the ammonium polysulfide which is formed permits the recovery of elemental sulfur in a crystalline form or, if so desired, the impurities present in the lead sulfide concentrate may also be recovered by conventional means which will include cyanidation of the residue in a leaching operation to recover silver or other precious metals.

The filtrate which contains the soluble lead halide is then passed to a crystallization zone. Inasmuch as temperature is an important factor in the solubility of lead halide, the soluble lead halide source is maintained at elevated temperatures, preferably in a range of from about 100° to about 105° C., until it is passed into the crystallization zone. The crystallization zone is preferably maintained at a temperature somewhat lower than the leach and separation temperatures and preferably in a range of from about 60° C. to ambient temperature (20°-25° C.) or lower, wherein the soluble lead halide will crystallize out due to a temperature drop. If temperatures lower than ambient are required, the lower temperatures may be obtained by the utilization of external cooling means such as an ice bath, cooling coils, other heat exchangers, etc.

The thus crystallized lead halide is recovered from the crystallization zone and separated from the barren leach solution, the latter, if so desired, being recycled to the leaching step for further use therein. The separated crystallized lead halide is then dried to remove any trace of water which may still be present, said drying being effected, if so desired, by placing the lead halide in an oven or other heating apparatus and subjecting the lead halide to a temperature of about 100° C. for a period of time ranging from about 0.1 up to about 4 hours or more, the duration of the drying period being that which is sufficient to remove all traces of the water. Following this the dried lead halide is then placed in an appropriate apparatus such as an electrolysis cell or fused salt bath and subjected to a temperature sufficient to melt the lead halide until it assumes a molten form. This temperature may range from about 380° C., which is sufficient to melt lead bromide, up to about 875° C., which is sufficient to melt lead fluoride. The lead halide in molten form is then admixed with a salt of a metal selected from the group consisting of alkali metals and alkaline earth metals. Examples of these salts of metals of Groups IA and IIA of the Periodic Table will include lithium chloride, sodium chloride, potassium chloride, rubidium chloride, cesium chloride, beryllium chloride, magnesium chloride, calcium chloride, strontium chloride, barium chloride, lithium bromide, sodium bromide, potassium bromide, rubidium bromide, cesium bromide, beryllium bromide, magnesium bromide, calcium bromide, strontium bromide, barium bromide, lithium fluoride, sodium fluoride, potassium fluoride, rubidium fluoride, cesium fluoride, beryllium fluoride, magnesium fluoride, calcium fluoride, strontium fluoride, barium fluoride, etc., in a fused salt bath. In the preferred embodiment, the salt of a metal of Groups IA or IIA of the Periodic Table will be comparable in the halide content to the lead halide which is to undergo electrolysis, that is, if the lead halide is lead chloride, the solid salt will comprise a chloride such as sodium chloride, potassium chloride, lithium chloride, calcium chloride, etc. It is also contemplated within the scope of this invention that the lead halide will undergo electrolysis in the presence of a mixture of at least two salts of the metals of Groups IA and IIA of the Periodic Table, examples of these mixtures comprising a sodium chloride-lithium chloride mixture, a potassium chloride-lithium chloride mixture, a magnesium chloride-calcium chloride mixture, a lithium bromide-potassium bromide mixture, etc. In the fused salt bath the mixture of salts will be subjected to electrolysis utilizing a sufficient voltage to effect said electrolysis whereby metallic lead is deposited as a liquid which can be removed from the fused salt. The lead may be removed continuously or bathwise. By effecting the electrolysis at an elevated temperature which is sufficient to maintain molten conditions, it is possible to remove and recover metallic lead from the electrolysis zone while the halogen molecules may be recycled back to the halogenation zone. By utilizing such a flow system, it is possible, after leaching the stoichiometric quantity of halogen necessary to react with the lead sulfide, to reuse the halogen in a recycle or closed system thereby obviating the necessity of added halogen in any large quantities. This lack of added halogen will contribute to the lower cost of the process in obtaining metallic lead from lead sulfide feed stocks.

It is also contemplated within the scope of this invention that the process of the present invention may be effected in a batch type operation. When this type of operation is used, a quantity of the charge stock is placed in an appropriate apparatus such as an oven or any other type of apparatus which is capable of being heated to relatively high temperatures. The charge stock is then subjected to a nitrogen or hydrogen purge which is maintained while the apparatus is heated to a temperature in the range of from about 300° to about 600° C. for a period of time sufficient to remove all volatiles and water from the charge stock. Thereafter the charge stock is removed and placed in an appropriate apparatus which is thereafter subjected to the action of a halogenating agent. Inasmuch as the halogenation of the concentrate is exothermic in nature, the heat of reaction which is evolved will be controlled within the desired operating range of from 80° to about 120° C., although it is contemplated that heating or cooling means may be provided to stabilize the temperature of the reaction. Upon completion of the conversion of the lead concentrate to the desired halide, the halogenated product is then subjected to the action of a brine solution such as sodium chloride while maintaining the temperature of the reaction in a range of from about 80° to about 120° C. After agitation of the solution for a period of time sufficient to dissolve the lead halide, the soluble lead halide is separated from the elemental sulfur and residue by conventional means such as filtration, decantation, etc., and recovered. The soluble lead halide which is still at an elevated temperature due to the maintenance of the temperature in a range of from 80° to 120° C. while separating the soluble lead halide from the solid material is passed to a crystallization zone which is maintained at a temperature lower than that of the separation zone, preferably in a range of from about 60° to ambient. The lead halide upon completion of the crystallization is separated from the barren leach solution in a manner similar to that hereinbefore set forth, and after separation, is removed to a drying zone. After drying the lead halide crystals they are then subjected to fused salt electrolysis whereby the desired metallic lead may be recovered therefrom.

The following examples are given for purposes of illustrating the advantage of subjecting the lead bearing source to a roast prior to halogenation thereof. However, it is to be understood that these examples are given merely for purposes of illustration and that they are not intended to limit the generally broad scope of the present invention in strict accordance therewith.

EXAMPLE I

A quantity of lead sulfide concentrate was subjected to a prechlorination activation at various temperatures in an inert atmosphere. The material to be roasted was placed in a vertical column which was purged with nitrogen. Following this the column was heated to a temperature of 400° C. and maintained thereat for a period of 30 minutes while maintaining the nitrogen flow through the column at a velocity sufficient to remove the volatiles from the ore as they were formed. In addition, another portion of the lead sulfide concentrate was treated in a manner similar to that set forth above, the temperature of the column being maintained at 500° C. for a period of 30 minutes. A third sample was subjected to a prechlorination roast at a temperature of 600° C. for a period of 30 minutes.

Following the prechlorination treatment, the 50 gram samples of 74% Pb assay were then chlorinated in a fluidized bed apparatus comprising a 1 inch diameter Pyrex tube. The chlorination was effected by charging chlorine gas at a rate of 60 cc/min. for a period of 90 minutes while maintaining the temperature of the apparatus at 100° C. At the end of this time, the samples were analyzed to determine the conversion of the lead and any trace metals such as iron, zinc, and copper which may be present to the respective chlorides. In addition, the chlorination step was also effected on a sample of lead sulfide concentrate which had not been subjected to the prechlorination roast but had been dried at a temperature of 110° C. The results of these tests are shown in Table I below:

TABLE I

| Temperature of Prechlorination Treatment | % Pb Conversion | % Fe Conversion | Pb/Fe Ratio | % Zn Conversion | Pb/Zn Ratio | % Cu Conversion | Pb/Cu Ratio |
|---|---|---|---|---|---|---|---|
| None (Drying at 110° C.) | 25.8 | 11.8 | 2.2 | 1.9 | 13.6 | — | — |
| 400° C. | 39.5 | 10.9 | 3.6 | 1.9 | 20.8 | — | — |
| 500° C. | 79.8 | 9.5 | 8.4 | 2.4 | 33.3 | — | — |
| 600° C. | 97.0 | 8.8 | 11.0 | 4.9 | 19.8 | 1.7 | 57.1 |

In addition to the selective conversion of lead to the corresponding chloride with a lower conversion of the trace metals to chlorides, it was found that the prechlorination roast also promoted a higher utilization of the chlorine which was fed to the system. When chlorine was fed to a system in which the lead sulfide concentrate had been subjected to a prechlorination roast, it was found that the conversion of lead sulfide to lead chloride followed the theoretical conversion rate up to levels of between 85 and 90%. This conversion rate did not occur when concentrates which had not been subjected to a prechlorination roast were chlorinated.

EXAMPLE II

As a further illustration of the advantage of employing an activation step prior to the conversion of the metals in the ore or concentrate to the halogenated derivatives thereof, and particularly chlorinated derivatives, a sample of concentrate was roasted for 15 minutes at a temperature of 600° C. in a nitrogen atmosphere. A comparison of the percentage of selectivity of lead sulfide chlorination over iron and zinc sulfide chlorination at various lead sulfide conversion levels is set forth in Table II below. It is to be noted that the higher number in the selectivities column is interpreted to mean that there is more lead conversion than impurities conversion.

TABLE II

| % PbS Conversion | Selectivities* Fe Roasted | Fe Unroasted | Zn Roasted | Zn Unroasted |
|---|---|---|---|---|
| 10 | 3 | 4 | 7 | 4 |
| 20 | 4 | 4 | 10 | 7 |
| 30 | 5 | 4 | 12 | 10 |
| 40 | 7 | 4 | 14 | 12 |

TABLE II-continued

| % PbS Conversion | Selectivities* Fe Roasted | Fe Unroasted | Zn Roasted | Zn Unroasted |
|---|---|---|---|---|
| 50 | 8 | 4 | 17 | 13 |
| 60 | 9 | 4 | 18 | 14 |
| 70 | 10 | 4 | 19 | 15 |
| 80 | 11 | 5 | 21 | 15 |
| 90 | 12 | 7 | 22 | 15 |
| 95 | 13 | 8 | 23 | 16 |

$$\text{*Selectivity} = \frac{\text{\% PbS conversion}}{\text{\% impurity sulfide conversion}}$$

Likewise, a comparison of the lead sulfide and impurity sulfide conversions along with the sulfur chloride production with roasted and unroasted lead sulfide is set forth in Table III below:

TABLE III

| Roast | Pb Conversion % | Fe Conversion % | Fe Sel. | Zn Conversion % | Zn Sel. | Weight $SCl_x$ Grms. |
|---|---|---|---|---|---|---|
| Neutral | 97.0 | 8.76 | 11 | 4.93 | 20 | 4.50 |
| Reducing | 85.8 | 13.8 | 6.2 | 4.38 | 20 | 5.53 |
| Unroasted | 81.0 | 13.7 | 5.9 | 5.00 | 16 | 29.6 |

It is to be noted from this table that the concentrate which has been subjected to an activation step in either a neutral or reducing atmosphere will produce a considerably less amount of sulfur chlorides than is produced when the concentrate is subjected to a chlorination step without the activation step. This smaller production of sulfur chlorides will thus enable the process to be run utilizing a smaller amount of halogenating agent such as chlorine gas with a concurrent more inexpensive production.

EXAMPLE III

The lead chloride chlorination product which may be obtained by utilizing the process set forth in Example I above may then be dissolved in a brine composed of sodium chloride and water, the dissolution of the product being effected while maintaining the temperature of the sclution at a temperature of about 100° C. The resulting slurry may be agitated for a period ranging from 0.25 to 1 hour and thereafter may be filtered while maintaining the temperature at about 100° C. The filtrate which is obtained from the above step and which contains soluble lead chloride may then be passed to a crystallizer which is maintained in a range of from 60° to about 40° C. The temperature drop in the crystallizer will allow the lead chloride to reprecipitate as crystals. The crystals may then be separated from the barren leach solution and dried at a temperature of about 105° C. for a period of 1 hour. Thereafter the crystals may then be admixed with sodium chloride and subjected to an electrolysis of the fused salts at a temperature of about 550° C. using a voltage of about 2.4 volts. The desired metallic lead which is formed by this electrolysis may then be recovered from the bottom of the cell by tapping the apparatus.

We claim as our invention

1. In a process for the production of metallic lead from a lead bearing source which comprises the steps of:

(a) halogenating said lead bearing source with a gaseous halogen;

(b) leaching the halogenated source with brine;

(c) filtering the resultant solution to separate elemental sulfur, residue and soluble lead halide;

(d) crystallizing said lead halide; and (e) recovering metallic lead by electrolysis, the improvement which comprises subjecting said lead bearing source to an activation heat treatment prior to the halogenation step.

2. The process as set forth in claim 1 in which said activation heat treatment is effected at a temperature in the range of from about 300° to about 600° C.

3. The process as set forth in claim 2 in which said activation heat treatment is effected in an inert atmosphere.

4. The process as set forth in claim 2 in which said activation heat treatment is effected in a reducing atmosphere.

5. The process as set forth in claim 1 in which said lead bearing source is chlorinated by treatment with chlorine gas at a temperature in the range of from about 80° to about 120° C.

6. The process as set forth in claim 1 in which said mixture is leached at a temperature in the range of from about 80° to about 120° C. with a sodium chloride solution.

7. The process as set forth in claim 1 in which said solution is filtered at a temperature in the range of from about 80° to about 120° C.

8. The process as set forth in claim 1 in which said electrolysis is effected by utilizing a molten salt mixture.

9. The process as set forth in claim 8 in which said molten salt is a sodium chloride-lead chloride mixture.

10. The process as set forth in claim 8 in which said molten salt is a potassium chloride-lead chloride mixture.

* * * * *